United States Patent [19]

Zicko

[11] 4,215,810

[45] Aug. 5, 1980

[54] CONTAINER WITH HINGED COVER

[75] Inventor: James A. Zicko, Natick, Mass.

[73] Assignee: Container Corporation of America, Chicago, Ill.

[21] Appl. No.: 52,412

[22] Filed: Jun. 27, 1979

[51] Int. Cl.[2] ..... B65D 5/34; B65D 5/22

[52] U.S. Cl. ..... 229/33

[58] Field of Search ..... 229/33

[56] References Cited

U.S. PATENT DOCUMENTS

| | | | |
|---|---|---|---|
| 1,420,000 | 6/1922 | Wagner | 229/33 |
| 2,964,228 | 12/1960 | Cote et al. | 229/33 |

*Primary Examiner*—Davis T. Moorhead

*Attorney, Agent, or Firm*—Carpenter & Ostis

[57] ABSTRACT pg,1 A container is formed with a tray portion and a cover portion hinged to the rear of the tray portion. A flap positioned between a side panel of the cover and a side wall of the tray prevents outward flaring of the side panels when the container is closed.

1 Claim, 6 Drawing Figures

CONTAINER WITH HINGED COVER

BACKGROUND OF THE INVENTION

1. Field of the Invention

This invention relates to a container formed from paperboard, or the like, and, more particularly to a container, having a tray and a cover hinged to a rear wall of the tray.

2. The Prior Art

The prior art is believed to be best exemplified by U.S. Pat. No. 2,094,448 to Evans which uses substantially more paperboard then the present construction, relies on doubling the paperboard on the sides for tightly securing the cover to the tray portion of the container, and produces outward flaring of the sides of the cover.

The present structure overcomes the disadvantages of the prior art and has a further advantage of being reaily adapted to machine set-up while the container of Evans and the structure disclosed in German Pat. No. 395,334 do not lend themselves to machine set-up.

SUMMARY OF THE INVENTION

A container has a tray and a cover hinged to the rear of the tray. A relatively small flap is hinged to a side panel of the cover and is sandwiched between the side panel of the cover and the side wall of the tray to retain the cover in closed position and to prevent outward flaring of the side panels of the cover when the container is closed.

DRAWINGS

Figure 1:
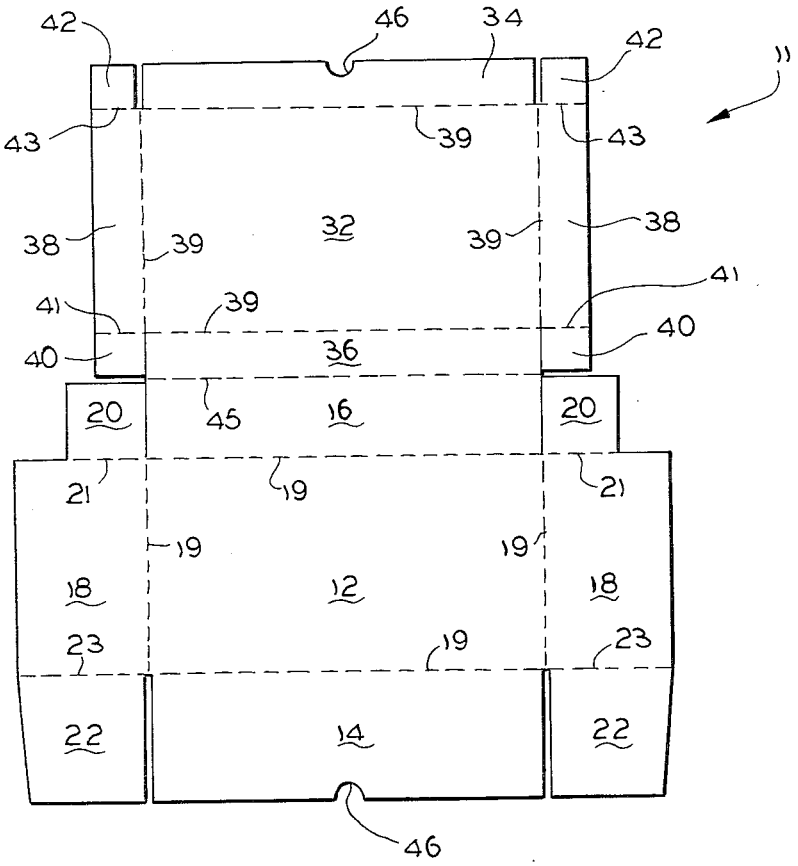
FIG. 1 is a plan view of a blank for forming a container of the present invention.
Figure 2:
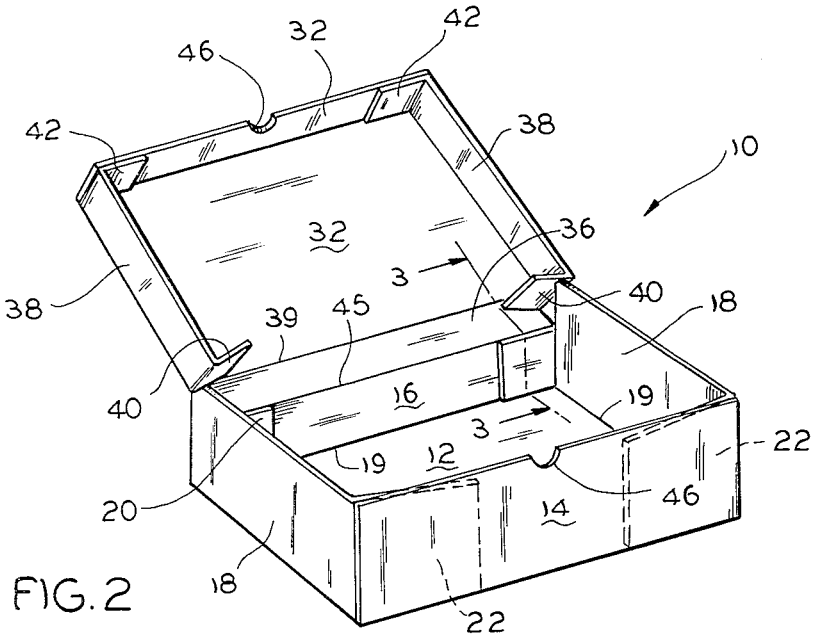
FIG. 2 is a perspective view of the container in an opened condition.
Figure 3:
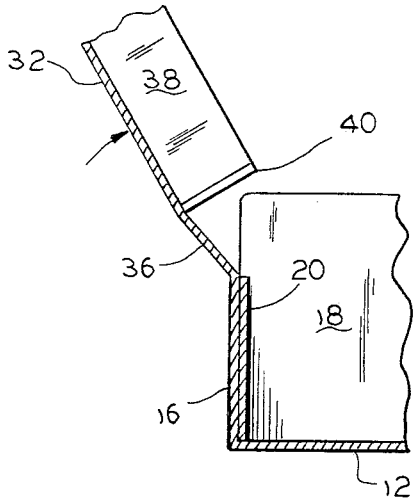
FIG. 3 is a sectional view of a portion of the container taken generally along the line 3—3 of FIG. 2.
Figure 4:
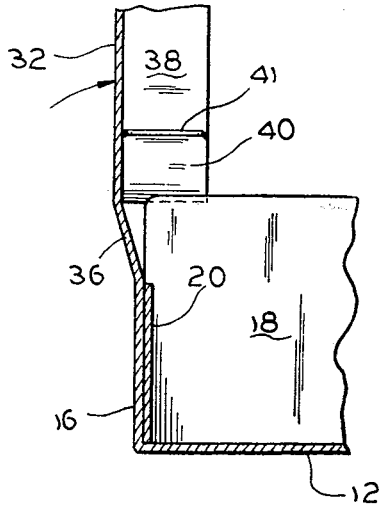
FIG. 4 is a sectional view similar to FIG. 3 but showing the cover being moved toward the tray.
Figure 5:
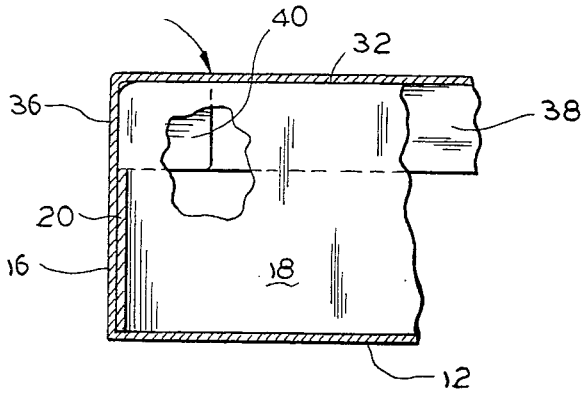
FIG. 5 is a sectional view similar to FIG. 4 but showing the cover in a closed position.

Referring now to the drawings, there is shown a container, generally designated 10, formed from a blank 11 illustrated in FIG. 1.

The container has a tray portion and a cover portion.

The tray portion includes a bottom wall 12, a front wall 14, a rear wall 16 and a pair of side walls 18. The front, rear and side walls are foldably connected to the bottom wall 12 along fold lines 19.

A tab 20 in hinged to an edge of each side wall 18 along a hinge line 21 and is secured in a face-to-face relationship to an inner surface of the rear wall 16 by adhesive of other securing means well known in the art.

The side walls 18 are provided with flaps 22 foldably attached to the side walls by fold lines 23. The flaps 22 are folded inwardly when the tray portion of the container 10 is erected and are secured, by adhesive or other well known means, to an inner surface of the front wall 14 to form a tray.

It will be noted that the tab 20 is substantially smaller than the flap 22 attached to an opposite end of each side wall 18 and in width substantially corresponds to the width (or height) of the rear wall 16 and is substantially narrower than the width (or height) of the side wall 18.

The container 10 has a cover portion which includes a top wall 32, a front panel 34, a rear panel 36 and a pair of side panels 38. The front, rear and side panels are foldably connected to the top wall 32 by hinge lines 39.

Figure 6:
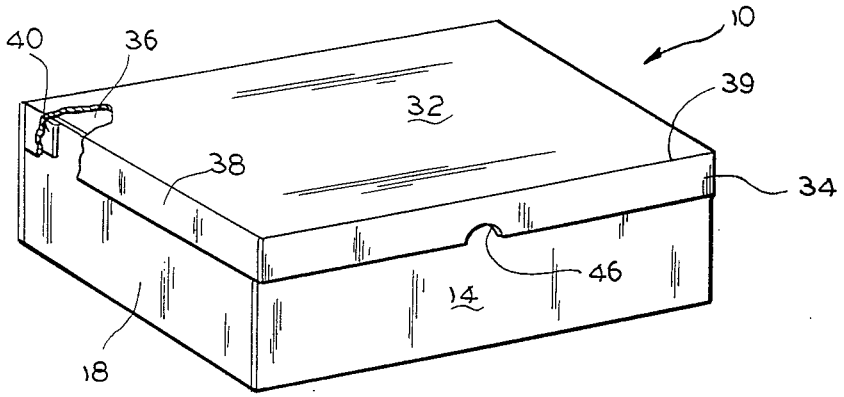
FIG. 6 is a perspective view of the container in a closed position with a portion cut away.

Each of the side panels 38 have flaps hinged to the respective end edges thereof. Flaps 40 are hinged to the rear end edges of the side panels 38 along hinge lines 41 and remain free of any other attachment. As best seen in FIG. 6, the flaps 40 are sandwiched between the side walls 18 of the tray portion and the side panels 38 of the cover portion when the container is closed thereby preventing accidental opening of the cover or an outward flaring of the side panels 38.

A flap 42 is foldably attached to a front end edge of each of the side panels 38 along fold lines 43. The flaps 42 are folded and secured in a face-to-face relationship to an inner surface of the front panel 34 by adhesive or other securing means well known in the art.

A score line 45 is provided for hinged atachment of the rear panel 36 to the rear wall 16. The score line is so oriented as to cause the cover to flip back and away from the tray when the cover is disengaged from the tray. The score line 45 may be deemed as being a reversely oriented line as compared with the fold lines and hinge lines of this structure since it permits swingable movement of the cover relative to the tray.

As illustrated in the present exemplary embodiment, the front wall 14 and the front panel 34 may be formed with finger receiving openings or recesses 46 to enable the user to open the container

I claim:

1. A container, formed from a blank of paperboard, or the like, and having an integrally formed hinged cover, said container comprising:

(a) a tray portion and a cover portion;

(b) said tray portion including:

(i) a bottom wall;

(ii) front, rear and side walls upstanding from a foldably connected to said bottom wall along fold lines;

(iii) a tab hinged to an edge of said side wall and secured in face-to-face relationship to the inner surface of said rear wall;

(iv) said tab being relatively narrow with respect to the width of said side wall to which said tab is hinged;

(c) said cover portion including;

(i) a top wall;

(ii) front, rear and side panels foldably connected to said top wall along hinge lines;

(iii) a flap hinged only to a rear edge of said side panel and being free of any other attachment;

(iv) said flap being sandwiched between said side panel and said side wall of said tray portion when said container is closed thereby preventing outward flaring of said side panels;

(d) a score line hingedly attaching said rear wall of said tray portion to said rear panel of said cover portion and causing said cover portion to drop back and away from said tray porion when said cover portion is disengaged from said tray portion.

* * * * *